United States Patent [19]

Duval

[11] 4,055,863

[45] Nov. 1, 1977

[54] APPARATUS FOR BATHING PERSONS

[76] Inventor: Lawrence Edward Duval, 219 Chestnut St., Denham Springs, La. 70726

[21] Appl. No.: 642,723

[22] Filed: Dec. 22, 1975

[51] Int. Cl.[2] ..... A47K 3/06; A61H 33/00

[52] U.S. Cl. ..... 4/173 R; 4/177 R; 4/185 AB; 128/365

[58] Field of Search ..... 4/152, 160–163, 4/173 R–175, 177, 179, 181, 185 AB, 185 HB, 191, 192, 146, 149; 128/365, 367, 369, 373

[56] References Cited

U.S. PATENT DOCUMENTS

| | | | |
|---|---|---|---|
| 1,533,174 | 4/1925 | Erdosy | 4/163 |
| 2,465,853 | 3/1949 | Dalton, Jr. | 4/149 |
| 3,010,116 | 11/1961 | Cowley | 4/173 X |
| 3,191,190 | 6/1965 | Lowry | 4/177 |
| 3,394,412 | 7/1968 | Olssen | 4/160 |
| 3,469,266 | 9/1969 | Hyde | 4/177 |
| 3,594,826 | 7/1971 | Maurer | 4/7 |
| 3,778,848 | 12/1973 | Lyytinen | 4/175 X |
| 3,945,058 | 3/1976 | Gardner | 4/163 |

*Primary Examiner*—Richard E. Aegerter
*Assistant Examiner*—Stuart S. Levy
*Attorney, Agent, or Firm*—Roy, Kiesel, Patterson, Hudson & Abadie

[57] ABSTRACT

A bathing apparatus for washing persons bedridden or unable to bathe themselves which apparatus has a body enclosure with lowerable side panels whereby persons can easily be placed in position for washing.

7 Claims, 17 Drawing Figures

APPARATUS FOR BATHING PERSONS

BACKGROUND OF THE INVENTION

1. Field of the Invention

This invention relates generally to bathing apparatus and more particularly to transportable bathing apparatus wherein the person may be easily positioned inside for bathing.

2. Prior Art

Hospitals and nursing homes are faced with the time consuming and expensive task of bathing many of their patients. This is particularly true in the case of bed-ridden patients where it is necessary for nurses to remove the patient from his bed and physically get into a shower to bathe the patient. As a result of this inconvenience, patients are not bathed as regularly as desired or they are not dried properly after their baths, both of which can lead to bed sores and the establishing of an unhealthy living environment.

SUMMARY OF THE INVENTION

It is therefore an object of this invention to provide a bathing apparatus that can be transported to the patient's bed.

A further object is to provide a bathing apparatus which can both wash and dry automatically the patient without the constant physical presence and attention of nurses.

A still further object of this invention is to provide a bathing apparatus into which patients can be easily positioned for bathing.

Other objects and advantages of this invention will become apparent from the ensuing descriptions of the invention.

Accordingly, a bathing apparatus is provided having a frame assembly for supporting a person to be bathed, retractable wall panels that extend from the frame assembly to form a water-tight chamber about which all but the person's head area can be enclosed within, a water source capable of supplying heated or cooled water to nozzles positioned about the enclosed body within the chamber and an air source capable of supplying warm or cool air to open ducts positioned about the enclosed body within the chamber.

PREFERRED EMBODIMENTS OF THE INVENTION

Figure 1:
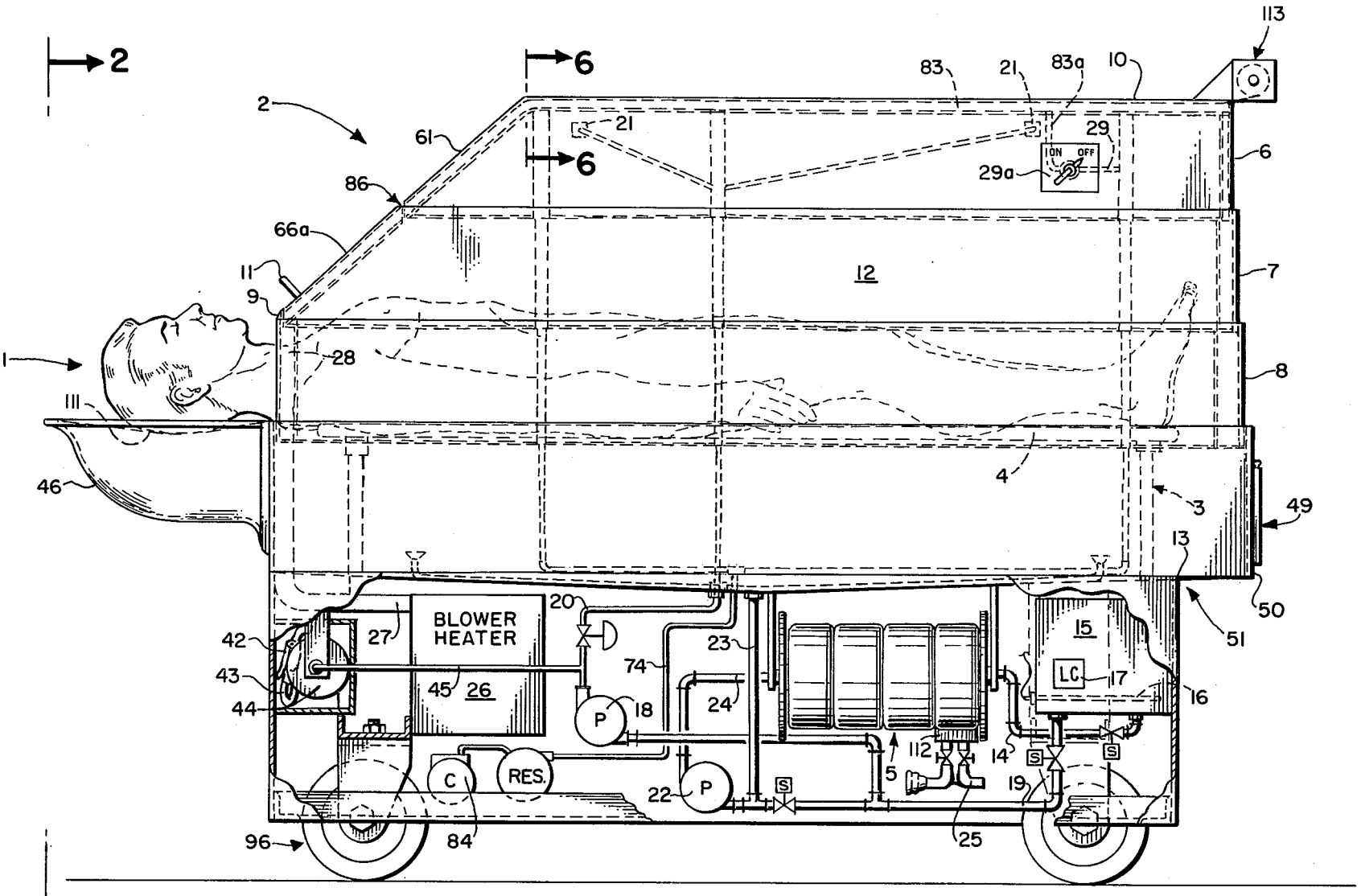
FIG. 1 is a cut-away perspective side view of one embodiment of this invention.
Figure 2:
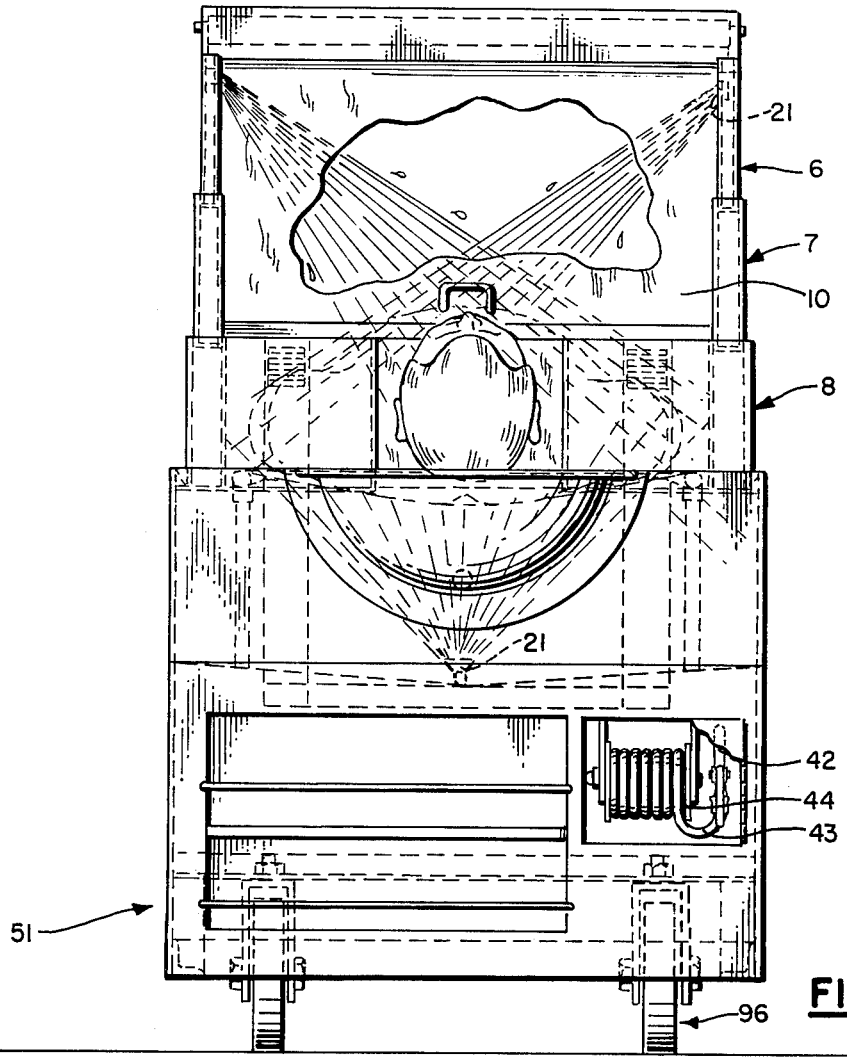
FIG. 2 is a cut-away perspective end view of one embodiment of this invention.
Figure 6:
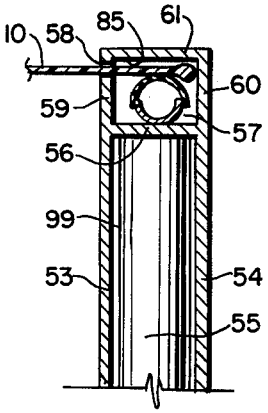
FIG. 6 is a cross-sectional view taken along lines 6 — 6 in FIG. 1 which illustrates the top shade in an unsealed position.
Figure 7:
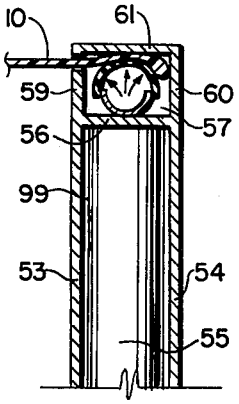
FIG. 7 is a cross-sectional view similar to that of FIG. 6 except top shade is in a sealed position.
Figures 3, 4, 5:
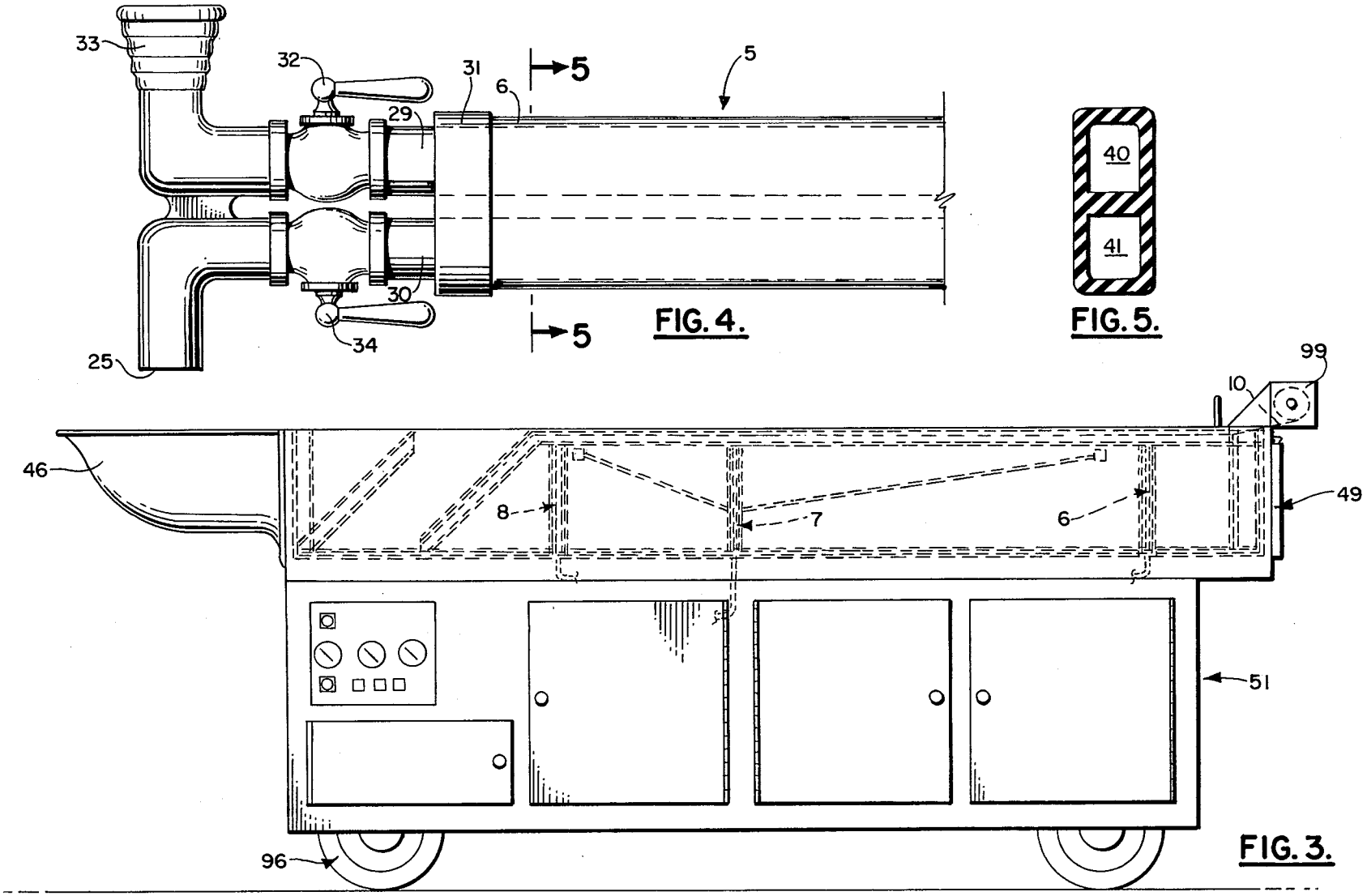
FIG. 3 is a perspective view of one embodiment of this invention wherein the side hood panels are in a lowered position.
FIG. 4 is a perspective view of one embodiment of the water hose connector.
FIG. 5 is a cross-sectional view taken along lines 5 — 5 in FIG. 4.

Referring generally to FIGS. 1, 2 and 3, the basic operating steps of the bathing apparatus 1 can be best explained. Bathing apparatus 1 is rolled into position next to the patient's bed. Then, with side hood panel assembly 2 in a lowered position (See FIG. 3) the patient is placed in a prone position on a flexible support webbing 4 of bed assembly 3 with the patient's head resting on head support webbing 5 of bed assembly 3. If necessary, the bathing apparatus is then rolled by wheel assemblies 96 to a convenient water source where water hose 112 of water hose assembly 5 can be unreeled and connected to the water source. Next, side hood panels 6, 7 and 8 of side hood panel assembly 2 are raised (See FIG. 1). After this is completed, head end sealing member 9 is attached to side hood panel 8 and top shade 10 is pulled from a retractable spring-loaded cartridge assembly 113 and across the top of the hood panels by handle 11 and connected to head end sealing member 9 in a water-tight sealing manner. In this position, the body of the patient (except for the head) is in a water-tight sealed chamber 12 which is formed by the raised side hood panels 6, 7 and 8, top shade 10, and flooring 13 of bathing apparatus 1.

Water is then passed from hose 112 through pipe 14 and into a reservoir tank 15 having a superheater means 16 until the desired water level has been reached as indicated by the level control means 17. This water in the reservior 15 is heated to the desired temperature by superheater means 16. The heated water is then pumped by pump 18 from reservoir 15 through pipes 19 and 20 leading to water spray nozzles 21. While the washing is taking place, the water is pumped out by pump 22 through pipes 23 and 24 to be emptied out in a wash basin through water hose outlet 25. After complete draining, pump 22 is shut off, blower 26 then forces air (heated if desired) through ducts 27 that have outlets 28 positioned about the patient's body whereby the body is air blown dried. After the body is dried, blower 26 is shut off, top shade 10 is pulled back, head end sealing member 9 is removed and side hood panels 6, 7 and 8 are lowered so the patient may be removed from the bathing apparatus.

In a particularly preferred feature, the water supply assembly 5 (See FIGS. 1, 4, 5 and 12) comprises water hose 112 which has two parallel non-connecting ducts (inlet duct 29 and outlet duct 30). Attached at one end of inlet duct 29 by restraining band 31 is, in a still more preferred feature, inlet valve 32 and attached to valve 32 is a "quick connect" clamp 33 (similar to those found in portable dishwashers). Attached by restraining band 31 at one end of outlet duct 30 is outlet valve 34, through which water can pass to water hose outlet 25. The other ends of inlet and outlet ducts 29 and 30 are attached to hollow stubs 35 and 36, respectively. Reel pipe 37 is connected at each end to pipes 14 and 24 by fitting and gland assemblies 38 and 39, respectively, which allow water to pass through cavities 40 and 41 to pipes 14 and 24, respectively, and which allows reel pipe 37 to rotate.

Figure 13:
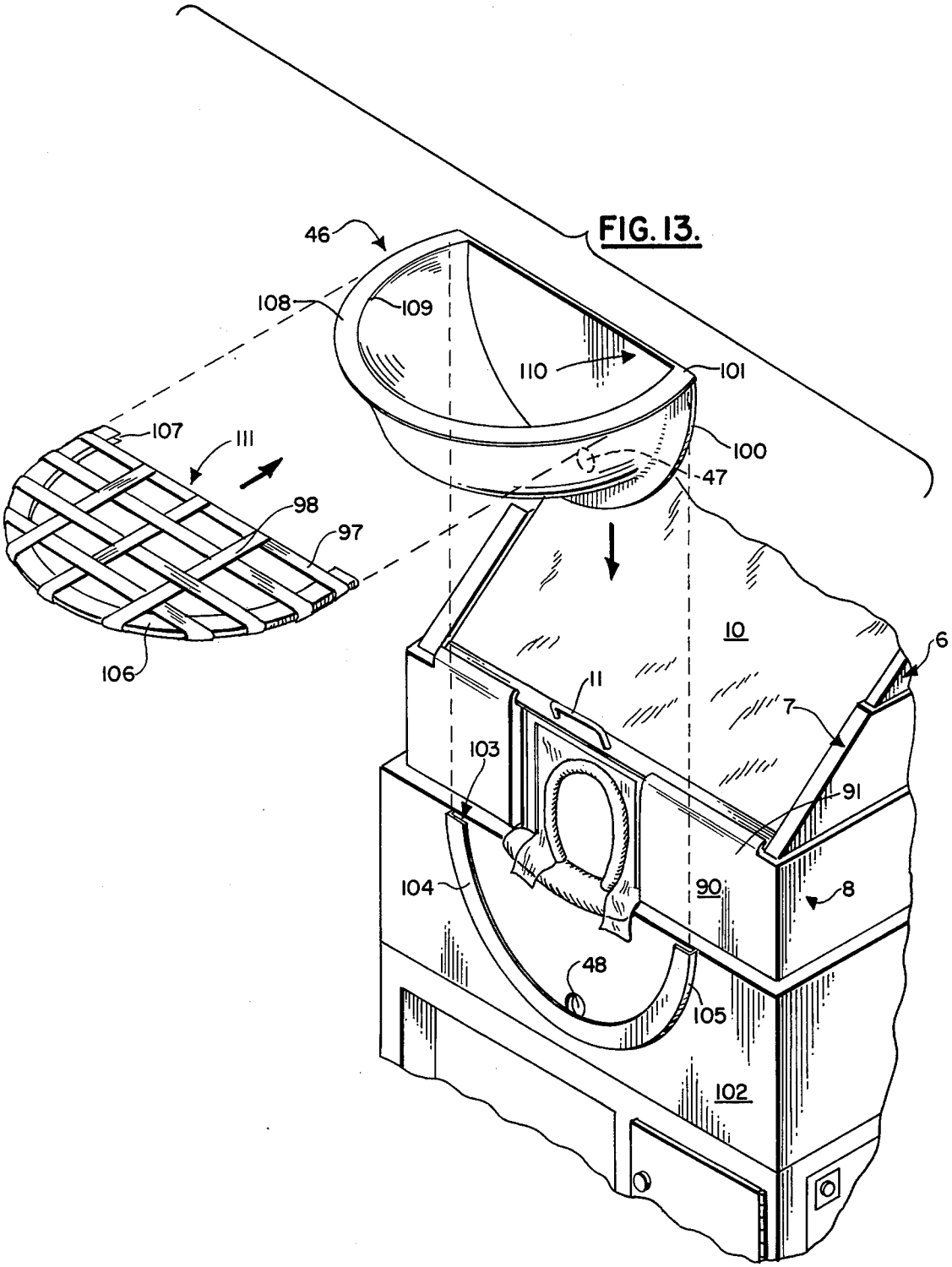
FIG. 13 is an exploded front end perspeective view showing in detail the head rest assembly.

In another preferred feature hand nozzle 42 (See FIG. 1) is attached to water hose 43 that can be reeled out from reel 44. The end of hose 43 is connected to pipe 45 which in turn is connected to pipe 19 through which passes the warm water for washing the patient. This hand nozzle can be used to wash the patient's head which is outside the enclosed structure. When this occurs, the water is caught by drain bowl 46 (See FIG. 13) which is provided with drain hole 47 that is aligned with opening 48 leading into the enclosed wash area. The water caught by drain bowl 46 can thus be channeled to drain pipe 23 and disposed of with all other wash water. In a more preferred feature, drain bowl 46 is provided with a flat ridge 100 about the circumference of bowl edge 101 adjacent to frame structure side 102 that fits into semi-circular slot 103 formed by a flat semi-circular slot 104 spaced from frame structure side 102 by plate member 105 perpendicular to plate 104 and side 102. In this embodiment, bowl 46 can be easily and quickly removed. In another preferred feature, head support webbing 111 comprises frame 106 to which webbing strips 97 and 98 are attached in perpendicular criss-cross pattern. Frame 106 preferably is provided with side slot 107 that slips about bowl ridge 108 that protrudes out from bowl lip 109 and perpendicular to bowl and plate 110. In this embodiment, head support webbing 5 can be easily removed for cleaning.

Figure 15:
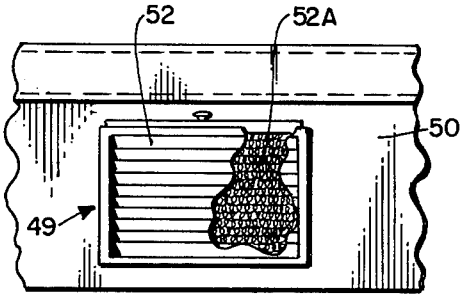
FIG. 15 is a cut-away perspective view of a de-mister means that may be used with this invention.
Figure 8:
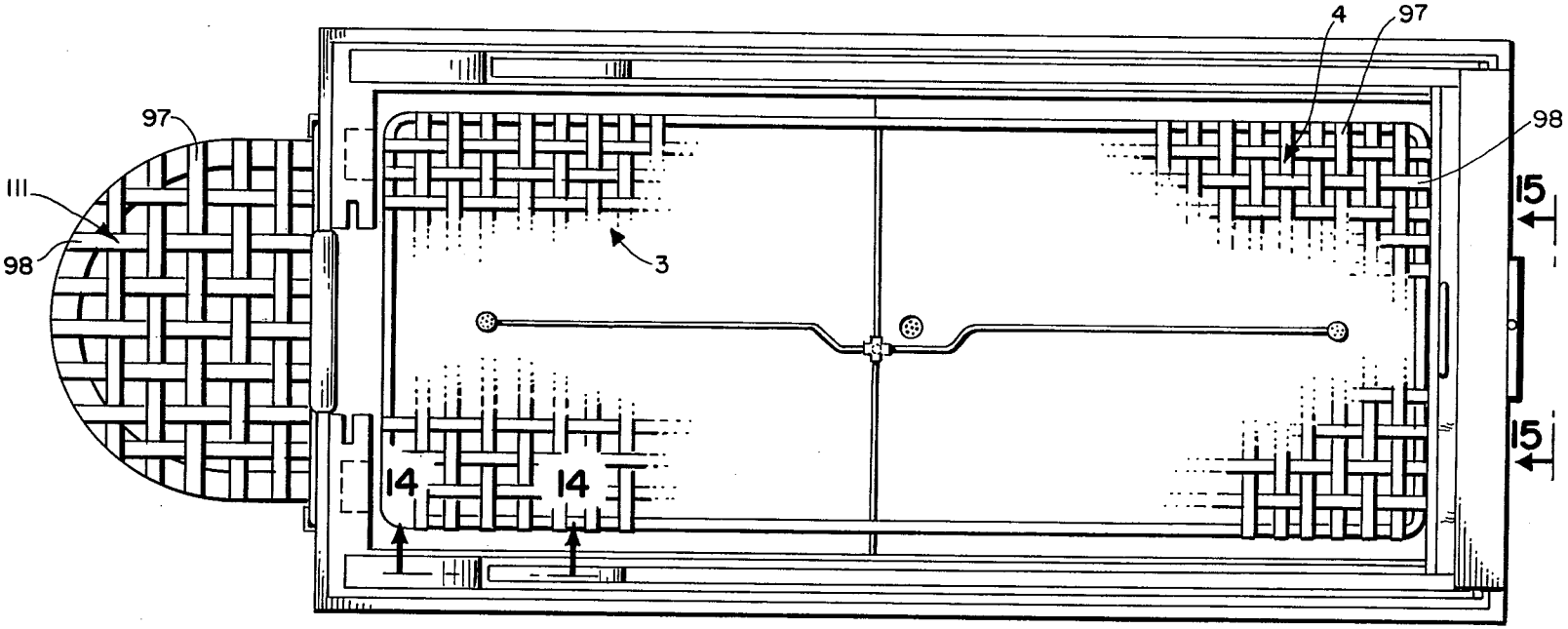
FIG. 8 is a cut-away perspective top view of one embodiment of this invention.
Figure 12:
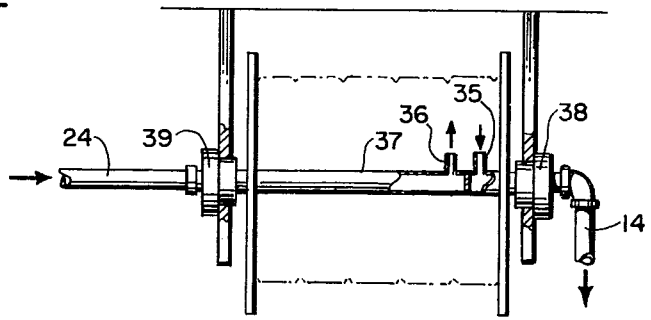
FIG. 12 is a cut-away perspective view of the water hose reel used in this invention.

In another preferred embodiment, the patient washing apparatus will be provided with a de-mister assembly 49 (See FIG. 8 and detail in FIG. 15) located inside end wall 50 of the bottom frame assembly 51 of bathing apparatus 1. The de-mister assembly 49 comprises an air venting section 52 having moisture collecting coils 52A facing toward the interior of the bathing apparatus.

Figure 9A:
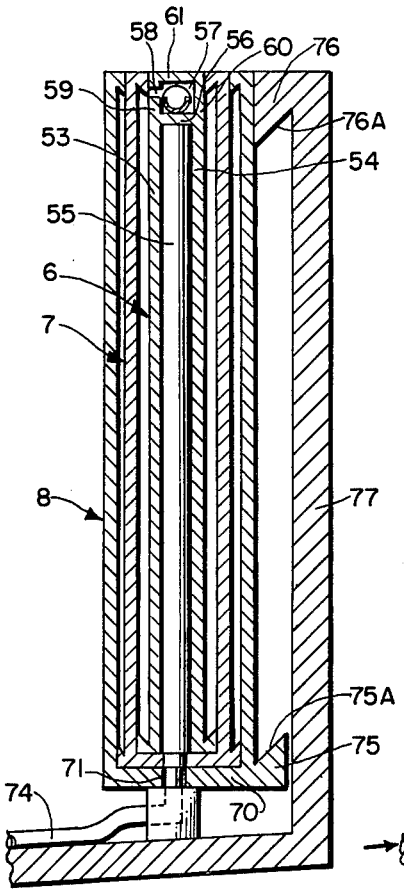
FIG. 9A is a cross-sectional view illustrating the position of the side hood panels in a completely lowered arrangement.
Figure 9B:
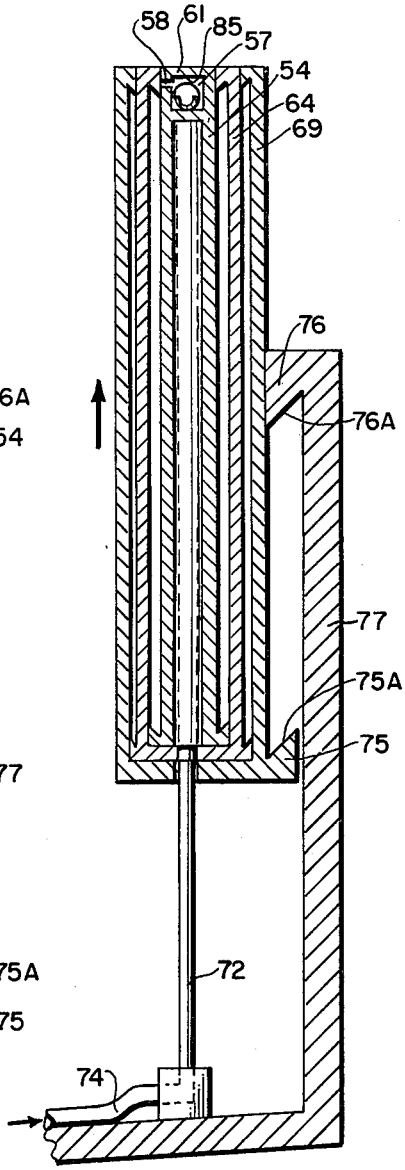
FIG. 9B is a cross-sectional view similar to FIG. 9A except with side hood panels partially raised.
Figure 9C:
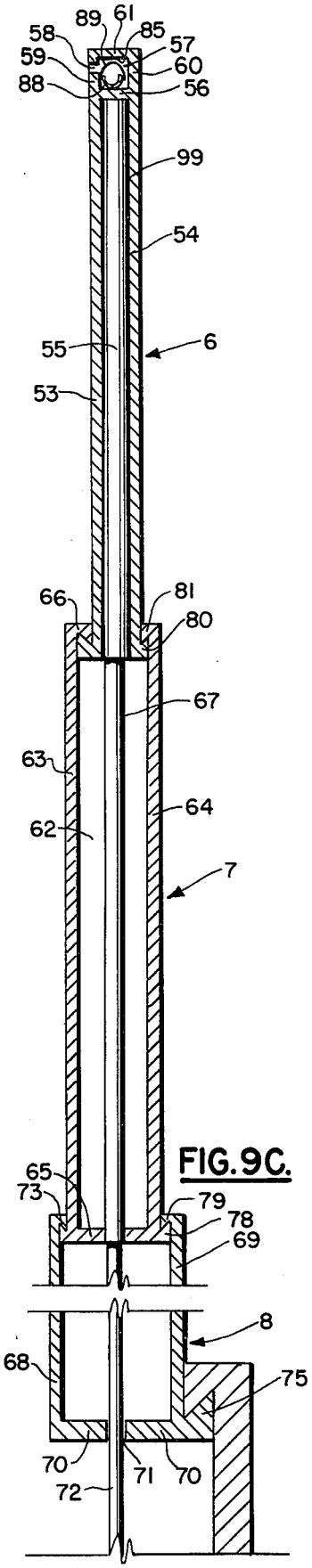
FIG. 9C is a cross-sectional view similar to FIG. 9A except with side hood panels completely raised as shown in FIG. 1.

A preferred structure for the side hood panels 6, 7 and 8 is seen in FIGS. 9A, 9B, and 9C. Side hood panel 6 comprises parallel wall members 53 and 54 which are separated by a cavity 55 which is sealed at the upper end by wall member 56. Inside cavity 55 is air duct 99 which runs parallel to walls 53 and 54 and is sealed by wall 56 at one end. At the top of wall member 56 a hollow channel 57 having an opening 58 for top shade 10 to pass is formed by lip wall member 59 being an extension of wall 53 and parallel thereto being wall extension 60 of wall member 54 that extends above lip section 59. Cavity 57 is completed by top section 61 attached to extension 60 and extending over wall section 56. In a lowered position, side hood panel 6 is telescoped into cavity 62 of side hood panel 7. Side hood panel 7, in a similar fashion, comprises parallel side walls 63 and 64, bottom 65, and top wall 66 which is provided with an opening for side hood panel 6 to pass through when raised and lowered. Side hood panel 7 is also provided with a tubular air duct 67 of an outside diameter slightly smaller than the inside diameter of cavity 55 of side hood panel 6 and in parallel alignment with cavity 55 so that side hood panel 6, when raised and lowered slips about air duct 67. Similarly, side hood panel 8 comprises side wall members 68 and 69 and bottom wall 70 having an opening 71 through which air duct 72 can pass. The air duct 72 has an outside diameter of slightly less than the inside diameter of air duct 67 so that side hood panel 7 raises and lowers about air duct 72 through an opening in top wall 73 of side hood panel 8.

To raise the side hood panel assembly 2 from the lowered position as shown in FIG. 9A to the raised position shown in FIG. 9C, air is introduced into tubing 74 which leads to and is connected to tubing 72. The air pressure inside cavity 55 forces side hood panel 8 as shown in FIG. 9B to begin to rise until locking member 75 contacts mating locking member 76 of bottom frame wall 77. In a particularly preferred feature, locking member 75 is block-shaped with a triangular-shaped piece removed from its upper portion to form a sloped wall surface 75A that is sloped outward and upward from the exterior surface of wall 69. Similarly mating locking member 76 has a sloped wall surface 76A that is sloped outward and downward from the interior surface of bottom frame wall 77. When side hood panel 8 is locked into position, side hood panel 7 begins to rise until locking member 78 of side hood panels 7 contacts mating lockimg member 79 of wall 73. Finally, in similar fashion, side hood panel 6 rises through cavity 62 of side hood panel 7 until its locking member 80 connects to mating locking member 81 of side hood panel 7. When raised, the side hood panels are maintained in position by the air pressure passing through lines 74 and ducts 72, 67 and 99 of the side hood panels.

Figure 14:
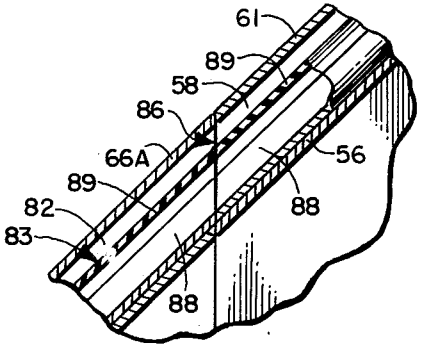
FIG. 14 is a cross-sectional view taken along lines 14 — 14 in FIG. 8 illustrating the seal along the sloped end portions of the side hood panels.

When all locking means are engaged, top shade 10 can now be pulled across and through slit openings 58 of side hood panel 6 and slit opening 82 of side hood panel 7 (See FIG. 14).

When top shade 10 is pulled across the top of side hood panels 6 and 7, it is desirable that a water tight seal be obtained. In a preferred feature, this can be obtained by providing side hood panels 6 and 7 (along its sloped top wall section 66A) with expandable tube member 83. Ends of tube member 83 are sealed with an opening 83A (See FIG. 1) connected to air source such as compressor reservoir 84 by way of tubing 74, air ducts 72, 67 and 99 and tubing 29 having shut-off valve 29A. When air is passed through tube member 83, it balloons up to force shade 10 against the lower surface 85 of top wall 61, thus forming a water tight seal.

To facilitate sealing at those positions 86 where side hood panels 6 and 7 join in the sloped region of top walls 61 and 66 A, tube member 83 (See FIG. 14) will comprise a non-flexible half 88 on top of which and connected thereto is flexible half 89. In this manner, tube member 83 can be better aligned at position 86.

Top shade 10 is pulled by handle 11 through openings 58 and 82 where it is then locked to end plates 90 which in a preferred feature (See 10 and 13) are provided with curved lips 91 under which shade 10 passes and is in water sealing contact.

Figure 11:
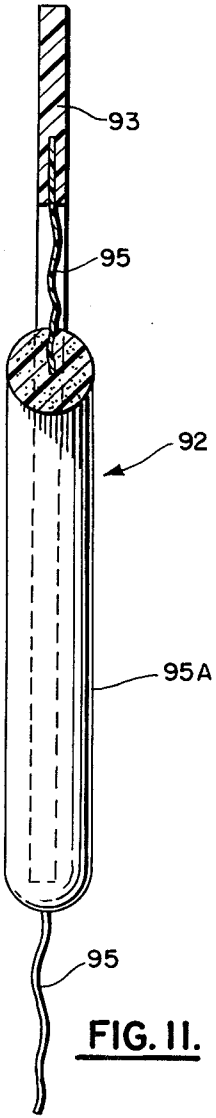
FIG. 11 is a cross-sectional view taken along lines 11 — 11 in FIG. 10.
Figure 10:
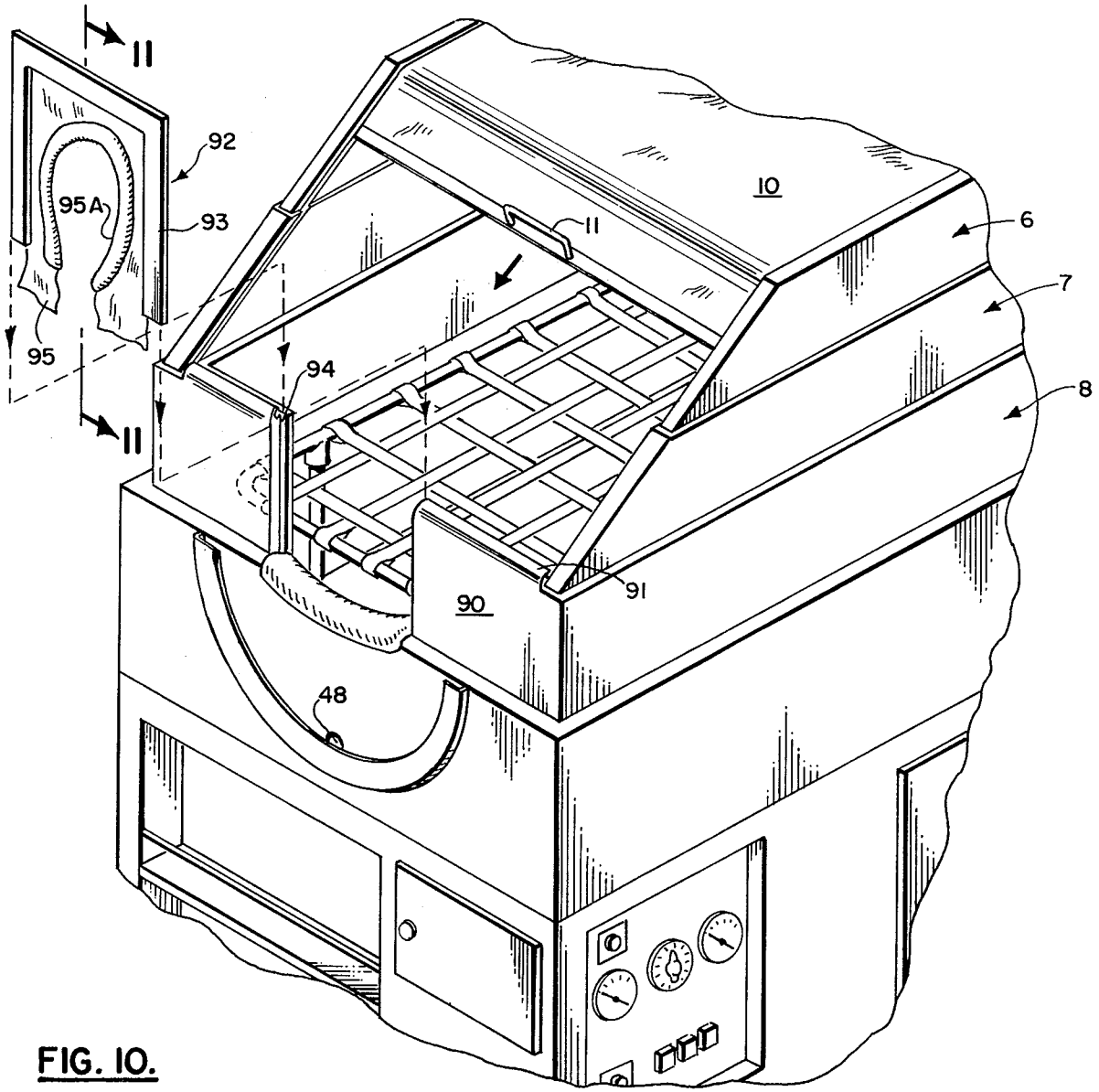
FIG. 10 is an exploded, front end perspective view of one embodiment of the invention.

Before top shade 10 is pulled into locked position under curved lips 91, head sealing assembly 92 (See FIG. 10) is positioned about the patient's neck by frame 93 slipping into mating slots 94 of end plates 90. In a preferred feature, head sealing assembly 92 comprises frame 93, flexible water-proof sheeting 95 and foamed collar 95A connected as shown in FIGS. 10 and 11.

In still another preferred feature bottom frame assembly 51 is provided with wheel assemblies 96 for transporting bathing apparatus 1 to desired locations.

It is also preferred that support webbings 4 and 111 be constructed of soft plastic webbing strips 97 that are either parallel with one another with gaps between them for drainage of water, or, more preferably, that strips 98 be woven perpendicularly to strips 97 for better support and stability of positioning whereby openings are formed in the webbing for water to pass through.

Other alternative features and embodiments, such as by way of example only, soap and medicant dispenser assemblies connected to reservoir 11, pulsating water nozzles, size of air ducts and amount of air and water pressure used, are obvious in view of the enclosures herein, and are meant to be included within the scope of the invention claimed.

What I claim is:

1. An apparatus for bathing a person which comprises:

a. compressed air producing means;

b. a drainable frame structure;

c. a bedding frame assembly attached to said frame structure and capable of supporting said person in and about horizontal position;

c. a canopy assembly attached to said frame structure to form a water-tight chamber about said persons body, said canopy assembly comprising:

i. a lower side panel and an upper side panel telescopically received in said lower said panel wherein said lower side panel comprises; two parallel spaced apart side walls, a bottom wall attached to said parallel side walls at their lower end and provided with locking means to limit the heighth to which said lower side panel may rise, and a top wall attached to said parallel side walls at the upper end and provided with a second locking means to contact and limit the height to which said upper side panel may rise, and wherein said upper side panel comprises: two parallel side walls spaced apart a distance to fit between said lower side panel's spaced apart side walls, a upper side panel bottom wall attached to the lower end of said upper side panel walls and provided with a first upper side panel locking means which mates with said second lower side panel locking means, ii. a retractable top shade including means attachable to said upper side panel to form a water-tight seal above said body, and;

iii. a front neck panel plate attachable to said lower side panel to form a water tight seal about said persons neck, and;

iv. means for introducing said compressed air to said upper and lower side panels for raising said upper side panel to a position whereby said upper side panel locking means contacts and second lower side panel locking means;

e. Spray nozzles attached to said frame structure including said upper side panels and positioned about said bedding frame structure to spray water to all areas of said person's body lying on said bedding frame assembly;

f. means for providing said water to said spray nozzles, said means connected to said spray nozzles;

g. Air ducts attached to said frame structure and having duct openings positioned about said bedding frame assembly and directed to force air from said compressed air means to all areas of said person's body lying in said bedding frame assembly; and.

2. An apparatus according to claim 1 wherein said means for attaching said top shade to said upper side panel included said upper side panel being provided with a slitted opening through which said top shade may pass.

3. An apparatus according to claim 2 wherein said slitted opening is formed by said upper side panel top wall and a cavity wall attached is said upper side panel top wall.

4. An apparatus according to claim 3 wherein inside said slitted opening is an expandable by said means for introducing said compressed air to said upper and lower panels tube member which when expanded will press said top shade against said cavity wall to form a water tight seal.

5. An apparatus according to claim 1 wherein drainable frame structure is provided with a de-misting means.

6. An apparatus according to claim 1 wherein wheel assemblies are attached to said frame structure to allow said apparatus to be moved to any desired location.

7. An apparatus according to claim 1 wherein said bedding frame assembly comprises a rigid frame member and flexible webbing members attached and stretched across said frame member any manner to allow said water to pass through them.

* * * * *